US007111734B2

(12) United States Patent
Robinson, Jr.

(10) Patent No.: US 7,111,734 B2
(45) Date of Patent: Sep. 26, 2006

(54) EDGE PROTECTOR

(76) Inventor: Jack B. Robinson, Jr., 107 Muirfield Dr., Spartanburg, SC (US) 29306-6629

( * ) Notice: Subject to any disclaimer, the term of this patent is extended or adjusted under 35 U.S.C. 154(b) by 418 days.

(21) Appl. No.: 10/686,228

(22) Filed: Oct. 15, 2003

(65) Prior Publication Data

US 2005/0082200 A1 Apr. 21, 2005

(51) Int. Cl.
*B65D 85/30* (2006.01)

(52) U.S. Cl. ..... 206/586; 206/453

(58) Field of Classification Search ..... 206/586, 206/591, 592, 453, 320
See application file for complete search history.

(56) References Cited

U.S. PATENT DOCUMENTS

| | | | | |
|---|---|---|---|---|
| 378,212 | A | 2/1888 | Palmer | |
| 974,871 | A | 11/1910 | Ferres | |
| 1,989,794 | A | 2/1935 | Duvall | |
| 2,160,221 | A * | 5/1939 | Masters et al. | 206/286 |
| 2,670,122 | A | 2/1954 | Davidson et al. | |
| 3,337,111 | A * | 8/1967 | Petriekis et al. | 206/586 |
| 3,613,985 | A | 10/1971 | Goodsite | |
| 3,982,682 | A | 9/1976 | Fremion | |
| 4,247,289 | A | 1/1981 | McCabe | |
| 4,399,915 | A | 8/1983 | Sorenson | |
| 4,771,893 | A | 9/1988 | Liebel | |
| 5,048,689 | A * | 9/1991 | McFarland | 206/586 |
| 5,431,985 | A | 7/1995 | Schilling | |
| 5,813,537 | A | 9/1998 | DeReu et al. | |
| 5,947,290 | A * | 9/1999 | Loeschen | 206/453 |
| 6,561,357 | B1 * | 5/2003 | Renck | 206/586 |
| 6,564,943 | B1 * | 5/2003 | Barton et al. | 206/395 |
| 6,595,367 | B1 | 7/2003 | Baechle | |
| 2002/0189969 | A1 | 12/2002 | Renck | |

* cited by examiner

*Primary Examiner*—Shain T. Luong
(74) *Attorney, Agent, or Firm*—McNair Law Firm, P.A.

(57) ABSTRACT

A blank sheet of foldable material having a plurality of laterally spaced parallel fold lines dividing the sheet into five consecutive panels to allow for folding of the panels into overlapping engagement. A first leg formed from folding panels two and three so that the top side of panel two is placed in face-to-face contact with the top side of panel three. A second leg intersecting the first leg formed from folding panels one, four, and five so that the top side of panel one is placed in face-to-face contact with the top side of panel four, and the top side of panel five is placed in face-to-face contact with the bottom side of panel one. An adhesive placed between panels two and three, panels one and four, and panels one and five for securing the panels to maintain the legs in a fixed folded arrangement with each other.

20 Claims, 4 Drawing Sheets

EDGE PROTECTOR

FIELD OF THE INVENTION

The present invention relates to protective packaging materials, and more particularly to an edge protector for placement on the interior or exterior of an article or container, which is uniquely constructed and arranged to maintain its shape for providing reinforcement and protection to the corners of articles and container while also being simple, fast and economical to assemble.

BACKGROUND OF THE INVENTION

Edge protectors, corner posts, and the like are generally known in the packaging industry to prevent damage to the edges of articles, as well as add strength to lightweight containers such as cardboard boxes to prevent crushing when stacked.

The prior art is replete with edge or corner protectors, or corner post supports. Examples can be found in U.S. Pat. Nos. 3,613,985; 3,982,682; 4,247,289; 4,399,915; 4,771,893; 5,431,985; 5,813,537; and 6,595,367, each of which have one or more of the following problems. While some provide good cushioning protection, they do not provide a load bearing capacity that strengthens a lightweight container sufficiently to allow for heavy stacking of multiple containers. Others that do provide structural reinforcement tend to be bulky, requiring large amounts of material that wastes valuable packaging space and add unwanted weight to the container. In either case, most protectors are typically expensive and time consuming to manufacture. Additionally, and perhaps the worst problem with most corner protectors is that they fail to hold their shape, causing them to be difficult to handle and properly place in a container or around the edge of an article. Sometimes, the edge protector may deform after it is placed in the container, leading to a structural collapse of the container and damage to the item contained therein.

Accordingly, it is an object of the present invention to provide an edge protector that maintains its shape once folded.

It is another object of the present invention to provide an edge protector that is easy and fast to assemble while being economical to produce.

It is another object of the present invention to provide an edge protector that works both as a cushioning member to protect articles, as well as a structural reinforcing member when placed in a container.

SUMMARY OF THE INVENTION

The above objectives are accomplished according to the present invention by first providing a blank sheet of foldable material having a top side and a bottom side. A plurality of parallel fold lines are scored into the sheet and laterally spaced to divide the sheet into five consecutive panels hinged together at the fold lines to allow for easy folding of the panels into overlapping engagement. A first leg is formed from folding the sheet to overlap panels two and three so that the top side of panel two is placed in face-to-face contact with the top side of panel three. Next, a second leg intersecting the first leg is formed from folding the sheet to overlap panels one, four, and five so that the top side of panel one is placed in face-to-face contact with the top side of panel four, and the top side of panel five is placed in face-to-face contact with the bottom side of panel one. An adhesive is included between the face-to-face contact of panels two and three, panels one and four, and panels one and five for securing the panels in overlapping engagement to maintain the first and second legs in a fixed folded arrangement with each other.

In a preferred embodiment, panels three and four are of equal width and panels one, two, and five are of unequal width each having a width less than panels three and four individually. Additionally, panel one preferably has a width less than the width of panel two, and panel five preferably has a width greater than the width of panel one and panel two individually.

In a further advantageous embodiment, the first leg and the second leg intersect at approximately a 90° angle with each other to provide an edge protector for right angles, as well as to reinforce the edges of paperboard boxes and the like.

Preferably, the blank sheet of foldable material comprises corrugated paperboard, which is inexpensive, durable, and easy to fold into the above configuration.

Advantageously, the fold line scored between panels one and two is scored on the bottom side of the sheet and the rest of the fold lines are scored on the top side of the sheet.

In a particularly advantageous embodiment, a double score fold line connects panel four and panel five wherein the double score fold line includes a pair of fold lines laterally spaced the thickness of the sheet for allowing panel five to be double hinged to panel four so that when panel five is folded into overlapping engagement with panel one, the double score allows panel five to easily fold around the thickness of panel one.

The above objectives are further accomplished according to the present invention by providing a method of preparing a box edge protector comprising the steps of providing a blank sheet of foldable material having a top side and a bottom side; scoring a plurality of laterally spaced parallel lines into the sheet so that the sheet is divided into five consecutive panels hinged together at the fold lines to allow for easy folding of the panels into overlapping engagement; folding the sheet at the fold line between panels two and three to overlap panels three and four with panels one and two so that the top side of panel two is placed in face-to-face contact with the top side of panel three, and the top side of panel one is placed in face-to-face contact with the top side of panel four; folding the overlapped panels at the fold lines between panels one and two, and, three and four, so that panels two and three form a first leg intersecting with a second leg formed by panels one and four; folding the sheet at the fold line between panels four and five so that the top side of panel five is placed in face-to-face contact with the bottom side of panel one for locking the first and second legs in position.

In a preferred embodiment, the method also includes the step of scoring the fold line between panels one and two on the bottom side of the sheet and scoring the rest of the fold lines on the top side of the sheet.

In a further advantageous embodiment, the method includes the step of folding the sheet at the fold line between panels one and two to form approximately a 90° angle between panels one and two prior to folding panel two into overlapping engagement with panel three, and folding the sheet at the fold line between panels three and four to form approximately a 90° angle between panels three and four prior to folding panel one into overlapping engagement with panel four.

Additionally, the preferred method includes the step of placing an adhesive on the top side of panels three, four, and five prior to folding for securing the panels in overlapping engagement when folded.

Advantageously, the method includes the step of spacing the score lines so that panels three and four are of equal width and panels one, two, and five are of unequal width each having a width less than panels three and four individually. Additionally, the score lines are spaced so that panel one has a width less than the width of panel two, and panel five has a width greater than the width of panel one and panel two individually.

Preferably, the method includes the step of arranging the first leg and the second leg to intersect at approximately a 90° angle with each other.

In a particularly advantageous embodiment, the method includes the step of scoring a double score fold line between panel four and panel five wherein the double score fold line includes a pair of fold lines laterally spaced the thickness of the sheet for allowing panel five to be double hinged to panel four so that when panel five is folded into overlapping engagement with panel one, the double score allows panel five to easily fold around the thickness of panel one.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
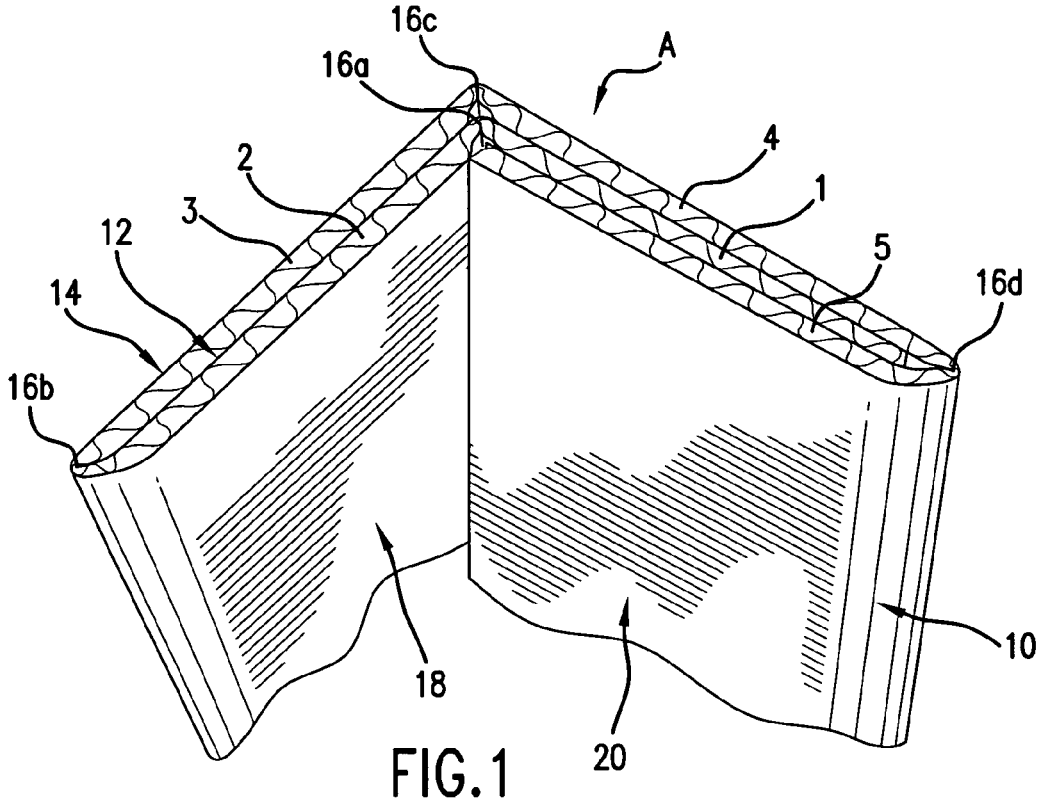
FIG. 1 shows a perspective view of the edge protector according to the present invention.

With reference to the drawings, the invention will now be described in more detail. Referring to FIG. 1, an edge protector, designated generally as A, is shown for protecting the edges and corners of articles during shipping, as well as reinforcing the corners of a shipping container.

Figure 2:
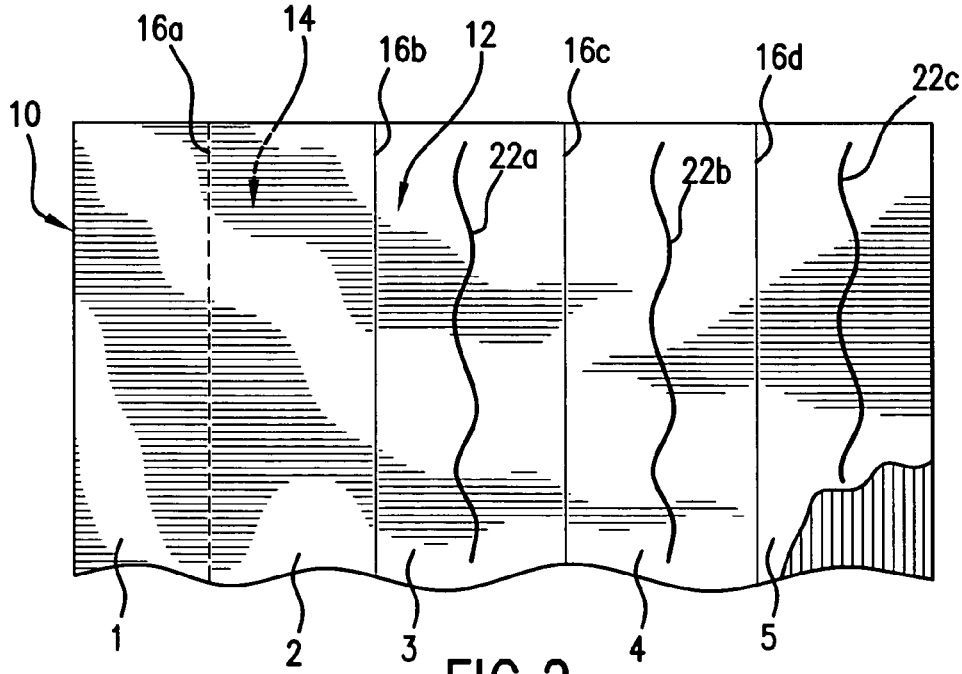
FIG. 2 shows a top view of a corrugated cardboard blank having a series of scored fold lines according to the present invention.

Referring to FIGS. 1 and 2, the edge protector starts as a blank sheet of foldable material, designated generally as 10, and is folded according to a particular arrangement described herein below into edge protector A, as shown in FIG. 1. Preferably, the blank sheet of foldable material comprises corrugated paperboard, or other like commonly known packaging material, which is inexpensive, durable, and easy to fold. To more easily describe the folding arrangement, sheet 10 is defined as having a top side, designated generally as 12, and an opposite bottom side, designated generally as 14, which is better seen in FIG. 3.

To prepare sheet 10 for folding, a plurality of parallel fold lines 16*a–d* are scored into sheet 10 and laterally spaced to divide the sheet into five consecutive panels numbered 1–5. The panels are accordingly hinged together at the scored fold lines to allow for easy folding of the panels into overlapping engagement. It is of particular importance that fold line 16*a* scored between panels 1 and 2 be scored on bottom side 14 of sheet 10, while the rest of fold lines 16*b–d* are scored on top side 12 of sheet 10. As is described in detail below, it is necessary for panel 1 to fold in an opposite manner as the rest of the panels, thereby necessitating fold line 16*a* to be scored on the bottom side of the sheet.

As shown in FIG. 1, a first leg, designated generally as 18, is formed from folding sheet 10 to overlap panels 2 and 3. A second leg, designated generally as 20, intersects first leg 18 and is formed from folding sheet 10 to overlap panels 1, 4, and 5. Advantageously, in a particularly preferred embodiment, an adhesive is place between the overlapping engagement of the panels to help hold them together and maintain the shape of the edge protector. Referring to FIG. 2, glue lines 22*a–c* are placed on top side 12 of panels 3, 4, and 5. Once folded, the adhesive is disposed between the face-to-face contact of panels 2 and 3, panels 1 and 4, and panels 1 and 5 for securing the panels in overlapping engagement and maintaining the first and second legs in a fixed folded arrangement with each other. Preferably, the adhesive is a cold adhesive so as not to immediately tack the panels together during folding to allow the panels to slide into place. As a practical matter, the folding process works best when the glue is placed on the above noted panels after scoring the fold lines and prior to any folding of the panels.

Figure 3A:
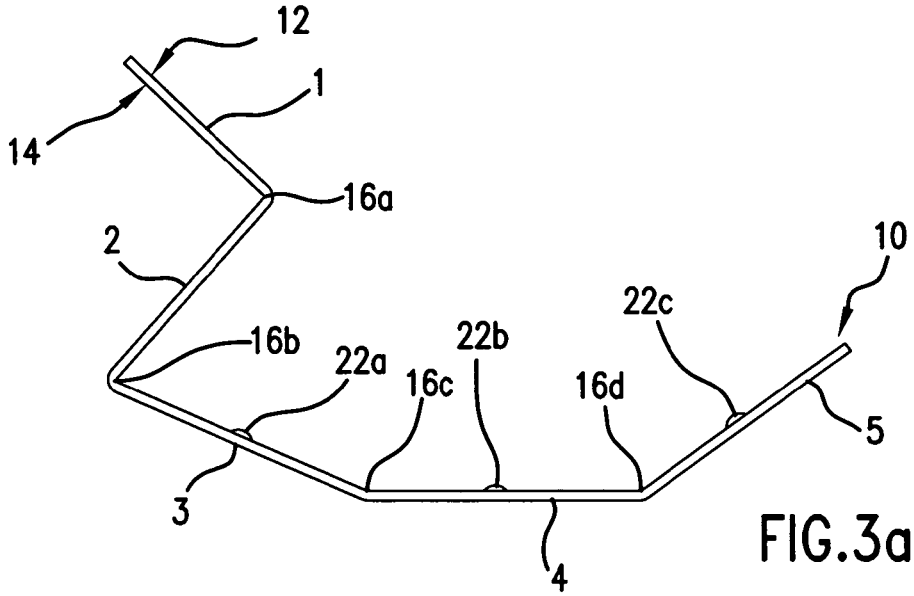
FIG. 3*a–d* shows perspective views of the corrugated cardboard blank in various folding stages to illustrate the construction of the edge protector according to the present invention.

Referring to FIGS. 3*a–d*, the folding arrangement will now be described with particularity. Referring first to FIG. 3*a*, fold lines 16*a–d* have been scored into sheet 10 and laterally spaced to divide the sheet into five consecutive panels hinged together at the fold lines to allow for easy folding of the panels into overlapping engagement. To ensure proper folding of the panels into overlapping engagement so that the panels do not separate and fit together as shown in FIG. 1, it is important that the panels be divided into varying widths for a given thickness. Particularly, it is necessary that panels 3 and 4 be of equal width, as these panels form the length of legs 18 and 20. Panels 1, 2, and 5, however, are required to be of unequal width with each having a width less than panels 3 and 4 individually. Particularly, it is necessary that fold lines 16*a–d* be spaced so that panel 1 has a width less than the width of panel 2, and panel 5 has a width greater than the width of panel 1 and panel 2 individually.

By way of example, a preferred embodiment of the invention to be most commonly used provides an edge protector with 2½" legs for wrapping around corners of articles and strengthening the interior corners of shipping containers. To provide the embodiment with 2½" legs that meets the other requirements set forth above as to panel width, requires sheet 10 to be approximately 11¾" in overall width with any desired length. The thickness of the material often ranges anywhere from ⅛" to ¾" or bigger. Preferably, the sheet material is between 1/16" to 3/16 and for this particular embodiment is 2/16". Based on this overall width of 11¾", panel 1 has a width of approximately 2 1/16", panel 2 has a width of approximately 2 5/16", panels 3 and 4 as noted above have a width of approximately 2½", and panel 5 has a width of approximately 2⅜". This allows the panels to fit together without any gaps between engaging surfaces and corners of the panels. It should be noted that the corners must be folded sharply or gaps will form between the panels, leading to a failure of the edge protector to hold its shape. By way of comparison, to provide an embodiment with 3" legs that meets the other panel width requirements set forth above, requires sheet 10 to be approximately 14⅛" in overall width with any desired appropriate length and a thickness of 2/16". Based on this overall width of 14⅛", panel 1 has a width of approximately 2 9/16", panel 2 has a width of approximately 2 13/16", panels 3 and 4 have a width of approximately 3", and panel 5 has a width of approximately 2⅞".

Figure 3B:
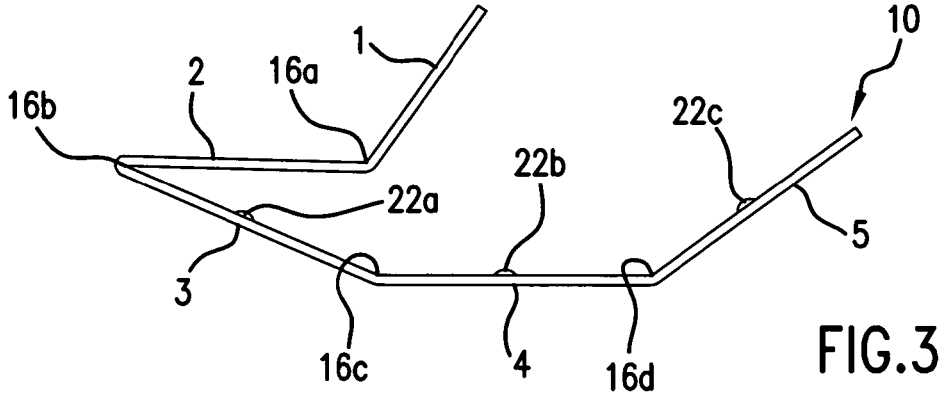
Figure 3C:
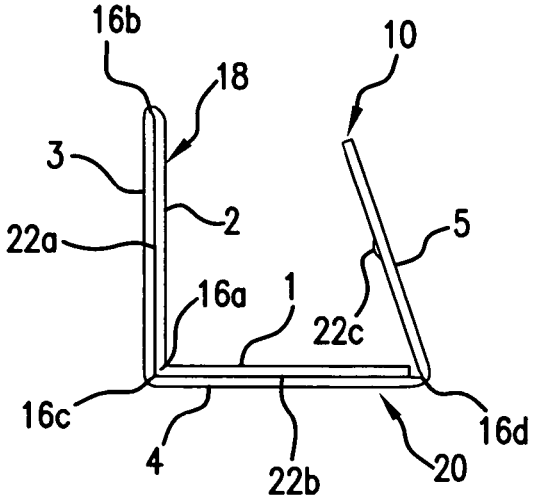

Generally, after sheet 10 has been scored, the sheet is then folded at fold line 16*b* between panels 2 and 3 to overlap panels 3 and 4 with panels 1 and 2 so that top side 12 of panel 2 is placed in face-to-face contact with top side 12 of panel 3, and top side 12 of panel 1 is placed in face-to-face contact with top side 12 of panel 4. As shown in FIG. 3*a*, it is particularly advantageous, however, to first fold sheet 10 at fold line 16*a* between panels 1 and 2 to form approximately a 90° angle between panels 1 and 2 prior to folding panel 2 into overlapping engagement with panel 3, as shown in FIGS. 3*b–c*. Again, note that fold line 16*a* is scored on bottom side 14 of sheet 10 to promote the folding of panel 1 as illustrated in the various Figures. Accordingly, when the sheet is folded at fold line 16*c* between panels 3 and 4 to form approximately a 90° angle between panels 3 and 4, panel 1 then comes into overlapping engagement with panel 4 and is already positioned at a 90° angle to panel 2, which provides good face-to-face contact between the panels.

Figure 3D:
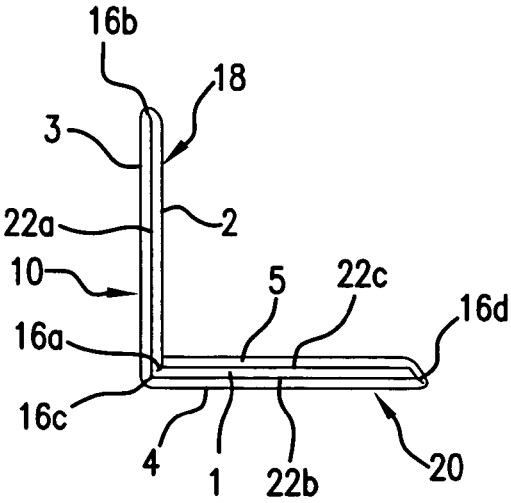

Referring to FIGS. 3*b–d*, first leg 18 is formed from folding sheet 10 at fold line 16*b* to overlap panels 2 and 3 so that top side 12 of panel 2 is placed in face-to-face contact with top side 12 of panel 3. At this point, as shown in FIG. 3*c*, panels 1 and 4 are also positioned in overlapping engagement so that top side 12 of panel 1 is placed in face-to-face contact with top side 12 of panel 4, which generally intersect panels 2 and 3 at a 90° angle.

Next, sheet 10 is folded at fold line 16*d* between panels 4 and 5 so that top side 12 of panel 5 is placed in face-to-face contact with bottom side 14 of panel 1, which locks the panels together in position through a combination of the folding arrangement and the adhesive discussed above provided in the form of glue lines 22*a–c*. This forms second leg 20 intersecting with first leg 18. Accordingly, second leg 20 is thus formed from folding sheet 10 to overlap panels 1, 4, and 5 so that the top side of panel 1 is placed in face-to-face contact with the top side of panel 4, and the top side of panel 5 is placed in face-to-face contact with the bottom side of panel 1.

Figure 4:
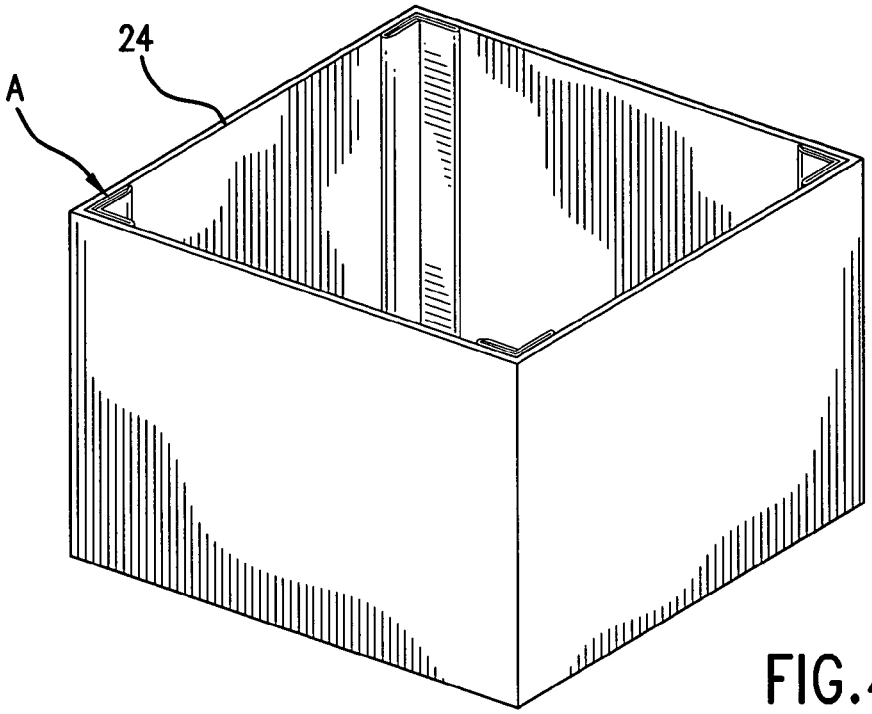
FIG. 4 shows a perspective view of one application of the edge protector according to the present invention.
Figure 5:
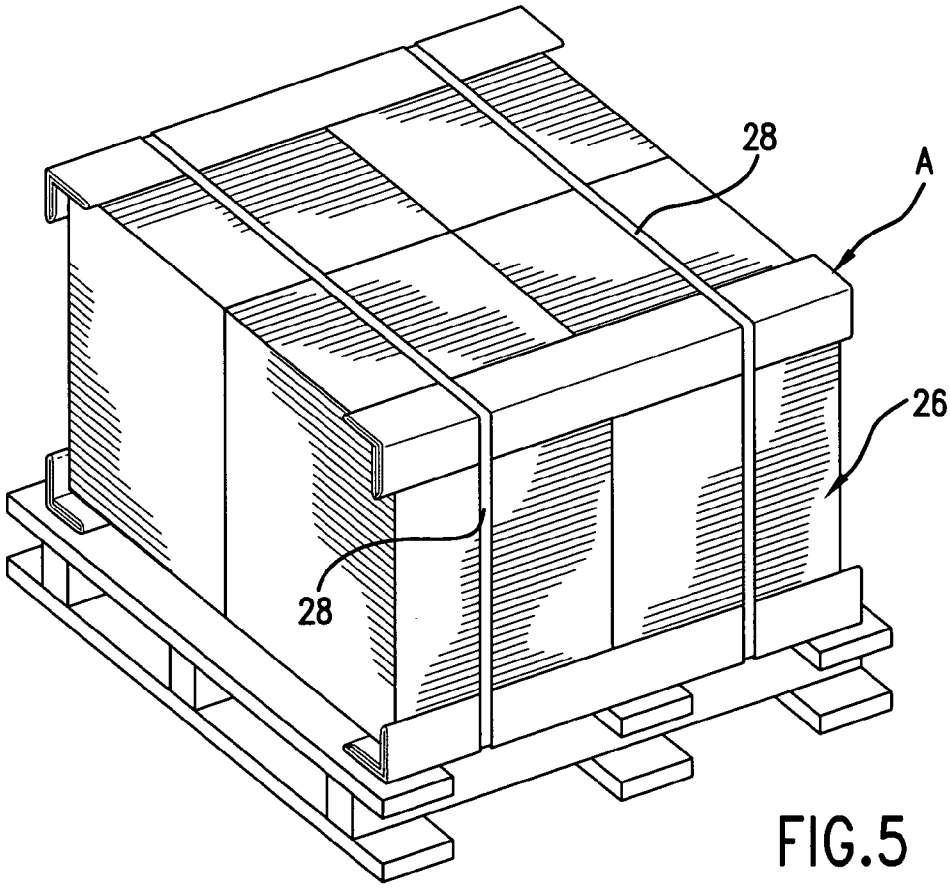
FIG. 5 shows a perspective view of another application of the edge protector according to the present invention.

Preferably, the first leg and the second leg intersect at approximately a 90° angle with each other to provide an edge protector for right angles, as well as to reinforce the edges of paperboard boxes and the like. Accordingly, referring to FIGS. 4 and 5, perspective views are provided showing some of the uses for the edge protector according to the present invention. As shown in FIG. 4, a cardboard box 24 includes edge protectors A positioned in all four corners of the box, adding structural stacking strength and resilience to the most important portions of the box without taking up large amounts of interior packaging space. Alternatively as shown in FIG. 5, a plurality of edge protectors A are used to protect the corners of a pallet of cartons, designated generally as 26, as well as holding the cartons in place by way of straps 28. In this manner straps 28 can be tightened to secure the load by biting into the edge protectors without any damage occurring to the cartons.

Figure 6:
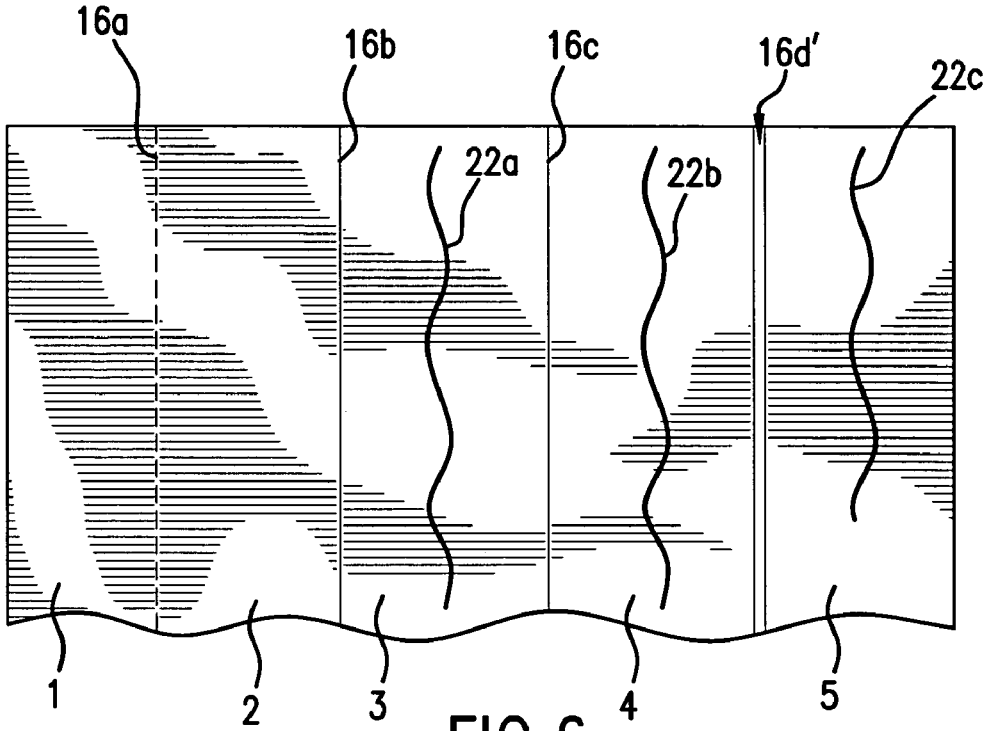
FIG. 6 shows a top view of a corrugated cardboard blank having a series of scored fold lines and glue lines according to an alternative embodiment of the present invention; and, FIG. 7 shows a perspective view of an alternative embodiment of the edge protector according to the present invention.
Figure 7:
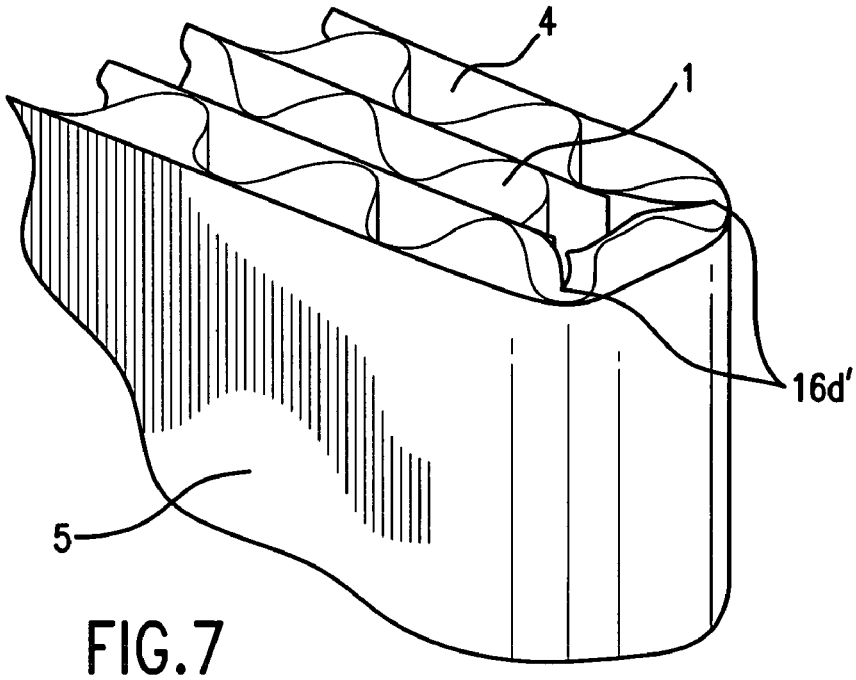

Referring to FIGS. 6 and 7, in an alternative embodiment, a double score fold line, designated generally as 16*d*', connects panel 4 and panel 5. Essentially, the double score fold line includes a pair of fold lines laterally spaced the thickness of the sheet for allowing panel 5 to be double hinged to panel 4 so that when panel 5 is folded into overlapping engagement with panel 1, the double score allows panel 5 to easily fold around the thickness of panel 1. This helps the panels hold their shape by reducing the force of panel 1 pushing against panel 5 at the fold line.

While a preferred embodiment of the invention has been described using specific terms, such description is for illustrative purposes only, and it is to be understood that changes and variations may be made without departing from the spirit or scope of the following claims.

What is claimed is:

1. An edge protector adapted for protecting edges and corners of an article or reinforcing the corners of a container when positioned therein, said edge protector comprising:

a blank sheet of foldable material having a top side and a bottom side;

a plurality of parallel fold lines scored into said sheet and laterally spaced to divide said sheet into a panel one, a panel two, a panel three, a panel four, and a panel five consecutively hinged together at the fold lines to allow for easy folding of said panels into overlapping engagement, wherein panels three and four are of equal width and panels one, two, and five are of unequal width each having a width less than panels three and four individually;

a first leg formed from folding said sheet to overlap panels two and three so that a top side of panel two is placed in face-to-face contact with a top side of panel three;

a second leg intersecting said first leg formed from folding said sheet to overlap panels one, four, and five so that a top side of panel one is placed in face-to-face contact with a top side of panel four, and a top side of panel five is placed in face-to-face contact with a bottom side of panel one; and, an adhesive included between the face-to-face contact of panels two and three, panels one end four, and panels one and five for securing said panels in overlapping engagement to maintain said first and second legs in a fixed folded arrangement with each other.

2. The edge protector of claim 1 wherein panel one has a width less than the width of panel two.

3. The edge protector of claim 2 wherein panel five has a width greater than the width of panel one and panel two individually.

4. The edge protector of claim 1 wherein said first leg and said second leg intersect at approximately a 90° angle with each other.

5. The edge protector of claim 1 wherein said blank sheet of foldable material comprises corrugated paperboard.

6. The edge protector of claim 1 wherein the fold line scored between panels one and two is scored on said bottom side of said sheet and the rest of the fold lines are scored on said top side of said sheet.

7. The edge protector of claim 1 including a double score fold line connecting panel four and panel five wherein said double score fold line includes a pair of fold lines laterally spaced the thickness of the sheet for allowing panel five to be double hinged to panel four so that when panel five is folded into overlapping engagement with panel one, said double score fold line allows panel five to easily fold around the thickness of panel one.

8. A method of preparing a box edge protector comprising the steps of:

providing a blank sheet of foldable material having a top side and a bottom side;

scoring a plurality of laterally spaced parallel fold lines into said sheet so that said sheet is divided into a panel one, a panel two, a panel three, a panel four, and a panel five consecutively hinged together at said fold lines to allow for easy folding of said panels into overlapping engagement;

spacing said fold lines so that panels three and four are of equal width and panels one, two, and five are of unequal width each having a width less than panels three and four individually;

folding said sheet at said fold fine between panels two and three to overlap panels three and four with panels one and two so that a top side of panel two is placed in face-to-face contact with a top side of panel three, and a top side of panel one is placed in face-to-face contact with a top side of panel four;

folding said sheet at said fold lines between panels one and two, and, three and four, so that panels two and three form a first leg intersecting with a second leg formed by panels one and four;

folding the sheet at the fold fine between panels four and five so that a top side of panel five is placed in face-to-face contact with a bottom side of panel one for locking said first and second legs in position.

9. The method of claim 8 including the step of scoring said fold line between panels one and two on said bottom side of said sheet and scoring the rest of said fold lines on said top side of said sheet.

10. The method of claim 8 including the step of folding said sheet at said fold line between panels one and two to form approximately a 90° angle between panels one and two prior to folding panel two into overlapping engagement with panel three.

11. The method of claim 10 including the step of folding said sheet at said fold line between panels three and four to form approximately a 90° angle between panels three and four prior to folding panel one into overlapping engagement with panel four.

12. The method of claim 8 including the step of placing an adhesive on said top side of panels three, four, and five prior to folding for securing the panels in overlapping engagement when folded.

13. The method of claim 8 including the step of spacing said fold lines so that panel one has a width less than the width of panel two.

14. The method of claim 13 including the step of spacing said fold lines so that panel five has a width greater than the width of panel one and panel two individually.

15. The method of claim 8 including the step of arranging said first leg and said second leg to intersect at approximately a 90° angle with each other.

16. The method of claim 8 including the step of scoring a double score fold line between panel four and panel five wherein said double score fold line includes a pair of fold lines laterally spaced the thickness of the sheet for allowing panel five to be double hinged to panel four so that when panel five is folded into overlapping engagement with panel one, said double score fold line allows panel five to easily fold around the thickness of panel one.

17. An edge protector adapted for protecting edges and corners of an article or reinforcing the corners of a container when positioned therein, said edge protector comprising:

a blank sheet of foldable material having a top side and a bottom side;

a plurality of parallel fold lines scored into said sheet and laterally spaced to divide said sheet into a plurality of consecutive panels including a panel one, a panel two, a panel three, a panel four, and a panel five;

said panels divided by said fold lines so that panels three and four are of equal width, and panels one, two, and five are of unequal width with each having a width less than panels three and four individually;

a first leg formed from folding said sheet to overlap panels two and three so that a top side of panel two is placed in face-to-face contact with a top side of panel three; and, a second leg intersecting said first leg formed from folding said sheet to overlap panels one, four, and five so that a top side of panel one is placed in face-to-face contact with a top side of panel four, and a top side of panel live is placed in face-to-face contact with a bottom side of panel one.

18. The edge protector of claim 17 wherein said first leg and said second leg intersect at approximately a 90° angle with each other.

19. The edge protector of claim 17 wherein said blank sheet of foldable material comprises corrugated paperboard.

20. The edge protector of claim 17 including a double score fold line connecting panel four and panel five wherein said double score fold line includes a pair of fold lines laterally spaced the thickness of the sheet for allowing panel five to be double hinged to panel four so that when panel five is folded into overlapping engagement with panel one, said double score fold line allows panel five to easily fold around the thickness of panel one.

* * * * *